US006059143A

United States Patent [19]

Weir

[11] Patent Number: 6,059,143

[45] Date of Patent: May 9, 2000

[54] PRESSURIZED FLUID SUPPLY APPARATUS USING PORTABLE COOLER FOR RESERVOIR

[76] Inventor: James F. Weir, 7437 Seneca Pl., La Mesa, Calif. 91941

[21] Appl. No.: 08/905,840

[22] Filed: Aug. 4, 1997

[51] Int. Cl.[7] ..... B67D 5/40

[52] U.S. Cl. ..... 222/61; 222/184; 222/185.1; 222/383.3; 222/529

[58] Field of Search ..... 222/55, 61, 184, 222/185.1, 333, 373, 383.3, 529

[56] References Cited

U.S. PATENT DOCUMENTS

| | | | |
|---|---|---|---|
| 2,804,992 | 9/1957 | Davis et al. | 222/383.3 |
| 4,613,059 | 9/1986 | Merkel | 222/55 |
| 5,111,966 | 5/1992 | Fridman | 222/185.1 |
| 5,154,317 | 10/1992 | Roppolo, II | 222/529 |
| 5,431,308 | 7/1995 | Tchen | 222/529 |
| 5,469,993 | 11/1995 | Hauf et al. | 222/393.3 |

*Primary Examiner*—Joseph A. Kaufman
*Attorney, Agent, or Firm*—Donn K. Harms

[57] ABSTRACT

A portable fluid pumping apparatus for use in combination a conventional ice chest or water container for providing a pressurized fluid supply for a portable shower or dish washing or other desired use requiring a portable pressurized fluid stream. The apparatus is capable of releasable mating to conventional round and square ice chests and water containers at the spigot on such containers. An optional belt for depression of spring loaded spigots is provided to depress the valve on such spigots during use. The device is adaptable to various shaped containers using an adaptive modular mounting system featuring resilient collar and cooperative fasteners which provide a stable mount between the device and the container to which it attaches.

20 Claims, 2 Drawing Sheets

PRESSURIZED FLUID SUPPLY APPARATUS USING PORTABLE COOLER FOR RESERVOIR

BACKGROUND OF THE INVENTION

1. Field of the Invention

The present invention relates to a portable pressurized fluid supply apparatus. More particularly this device disclosed as the present invention relates to an apparatus for supply of a pressurized water stream using a conventional water cooler or ice chest as the reservoir. The device is modular and adaptable to various conventionally sized water coolers for releasable attachment thereto allowing the water coolers to be both as a reservoir for the water supply apparatus as well as allowing the water cooler to be used without the apparatus attached in its original configuration.

2. Prior Art

Small round water coolers have in recent years become popular for a portable supply of potable water. Such coolers are used on construction sites, camping, in automobiles, and wherever a potable water supply is desired but not always available.

The use of such coolers is especially popular on construction sites where no plumbing has been installed as a source of drinking and wash water. Such water containers are also popular at camp sites lacking in a readily available water supply for drinking, cooking, and washing of utensils used for eating and preparation of food.

Currently, if a construction worker or camper is desirous of a water supply for a shower or washing of cooking or eating utensils, the gravity fed spigot at the exterior of commonly used insulated water containers is the sole source when camping or at a construction or other site lacking a water supply. Attempts at washing ones self or dirty plates and utensils are a constant source of frustration since the gravity powered water supply from the hand activated spigot on conventional ice chests and insulated and similar water containers yield at best, an inefficient supply of water for the purpose.

U.S. Pat. No. 5,251,344 (Blomet) teaches a tank for a portable shower using sterile water in the tank for a fluid supply. Blomet however requires a specialized tank and lacks the ability to use conventional water coolers.

U.S. Pat. No. 3,760,431 (Schwibner) teaches a portable shower assembled from a water container using a kit which requires extensive modifications to the water container. It also requires a sealed tank and would thus not work well on conventional ice chests and water containers because of those extensive required modifications and the lack of sealing ability of such conventionally used ice chests and water containers.

U.S. Pat. No. 4,104,744 (Odencrantz) teaches discloses a portable washing device using a pump and a sealed chamber container. Again, as in the aforementioned disclosures the container in Odencrantz requires a sealed condition to operate and the container is specialized for the job and not convertible back to use as an ice chest or water container for portable use.

U.S. Pat. No. 5,090,214 (LoGioco) teaches the use of an ice chest for a reservoir for a portable sprayer, however LoGioco requires extensive modification to the ice chest rendering it unusable for any other purpose.

U.S. Pat. No. 5,111,538 (Chapman) discloses a portable hot water shower device but again requires a very specialized reservoir tank and is incapable of using conventional plastic ice chests and water containers as taught.

U.S. Pat. No. 5,251,345 (Pechner) teaches a portable shower device which however requires a specially configured water reservoir incapable of any other use.

Consequently there exists a need for an apparatus which will allow a camper and construction worker alike, the ability to easily rinse of their body and their cooking and other gear, but, concurrently allows for the use of widely used and sold water containers and ice chests with little or no modification, for the reservoir. Such a device should be easily attached and detached to conventionally used water containers and ice chests, with little or no modification thereto, allowing to use of the container as an ice chest or simple water container when pressurized water is not required. Such a device should have an on board renewable power supply and provide a sufficient stream of water under pressure on demand for showers, washing, or other uses where a pressurized stream of water or liquid is desirable in a portable fashion.

Further, such an apparatus should be easily adaptable and attachable to the various sized containers currently owned and sold and adaptable to new sized containers of the owner should one be purchased, thus allowing great utility of adaptation of size and easy attachment and detachment when not in use.

SUMMARY OF THE INVENTION

Applicants' device is an easily manufactured and operated apparatus for use by releasable attachment to the majority of water containers and insulated ice chests and such containers sold and used about the world. The device, imparts to the user the utility of easy attachment and detachment to widely sold and used round or square shaped portable water containers or insulated containers such as ice chests with little or no modification thereto. Using adaptable interface connections for mating of the device to such containers, the apparatus may be reconfigured to attach to newly acquired containers of differing dimensions in the future.

When releasably attached to such ice chests or insulated water containers, the device uses the container as a reservoir to supply a pressurized stream of water on demand to the user by easy attachment of conduits feeding a pump to the standard spigot of currently used and sold ice chests and insulated liquid containers.

When attached to the such containers which then act as a liquid reservoir, applicant's device functions to supply pressurized water upon demand using an on board pump powered by an electric motor connected to a self-contained battery or optional AC from the power grid attached to a transformer to yield the correct current, or DC power hookup from an automobile DC system or a generator.

Applicant's device consists of a base having a top plate shaped to releasably attach to conventionally used liquid containers such as the Igloo® or Coleman® containers. Applicant's device can also be manufactured with a removable adaptive mount attachable to the top plate of the base. The adaptive mount would be replaceable with differing sized adaptive mounts. This replaceable adaptive mount thus allows for the same base and pumping unit to be attachable to a wide variety of sizes and shapes of such liquid containers and ice chests and for use of the same base on newly acquired containers of the user thus avoiding obsolescence when the container is changed in the future.

The device is easily manufactured from plastic material such as polyethylene, polypropylene, polyvinlycholride, or other plastic materials or mixtures thereof, by injection molding of the entire device or by formation of the device in pieces which are fitted together. The mount for the liquid container used for the reservoir is a collar which shaped to communicate with the perimeter of the base of the liquid container in a removably attached fashion. Additional releasable attachments such as Velcro® style hook and loop fabric may be used to achieve an even more secure mount between the base and the liquid container allowing the entire mated device to be lifted and carried using the handle on the container.

The collar being plastic may be formed with resilient characteristics and if sized to slightly stretch and friction fit the perimeter of the liquid container, a sufficient friction attachment between the base and liquid container may be achieved to alleviate the need for other attachment such as the hook loop fabric. However, the most secure releasable attachment is achieved using hook loop fabric or other conventional releasable mechanical fasteners.

The base contains a pump which communicates with the liquid supply in the container through a conduit connected to a spigot receiving mount upon the base. In cases where the conventional spigot upon the container is of a configuration which twists to allow liquid flow therethrough, when the spigot is inserted into the spigot receiving attachment upon the base, water flow to the conduit communicating with the pump is achieved. Since the container is mounted above the apparatus, the additional benefit of gravity assist is acquired to aid the pump in obtaining a constant flow of liquid. Where a push button or biased spigot activator is used on the conventional container for activation of liquid flow through the spigot, a biasing device is used such as a Velcro® strap or a plastic or metal clip to maintain the push button or biased valve in an open position to allow fluid flow therethrough to the conduit supplying the pump.

When in use to provide a pressurized water supply and mated to a container the portable device provides an on demand flow of fluid using a conventional portable pump such as those used for recreational vehicles. Such pumps have a self-contained electric motor connected to a pumping device providing the pumping device power to pump the liquid therethrough which normally begins to pump upon being activated with a switch or other manner of providing electric current to the motor. A pressure sensor which deactivates the pump motor when outlet line pressure builds to a pre prescribed level is normally activated in such conventional pumping devices and the sensor then interrupts the electrical circuit providing power to the pump motor ceasing fluid flow.

Using a hand held shower head or similar device mounted in line with a conduit in communication with the outflow from the pump, with the shower head having a biased or other on/off valve, the user would activate the fluid flow by activation the on/off valve. When the user deactivates the on/off valve, the flow of liquid stops, building line pressure and wherein the pressure sensor deactivates the pump motor at the pre prescribed pressure level.

Power to the electric pump motor is provided by an onboard battery pack such as a small sealed motorcycle battery, or a connection to a DC power supply such as an automobile cigarette lighter, or a solar panel directly or combined with a battery, or to an AC power supply connected to a conventional plug in transformer which exits the proper voltage DC power, or by combinations of the above. The on board battery pack can be recharged when connected to the AC power supply and transformer or to a DC power supply or conventional solar panel while power is concurrently made available to the motor for the pump.

An object of this invention is providing an easily used and maintained apparatus to supply a pressurized water or liquid supply using conventional and widely owned and used water containers or ice chests as a reservoir.

It is a further object of this invention is to provide an easily manufactured and operated apparatus capable of providing a pressurized water stream the device being easily attached and dis-attached to conventional water containers and ice chests.

An additional object of this is invention is to provide a device which is easily adapted to a wide variety of sizes and shapes of such water containers and ice chests.

A further object of this invention is to provide users the ability for a portable shower or other on demand pressurized water supply in locals where pressurized water is not available.

Another object of this invention is to make a device available to provide a pressurized fluid or water stream using conventional water containers and ice chests as a reservoir the device being easily attached and detached from the container to allow use of the container without the attached invention.

An additional object of this invention is to provide a portable pressurized water or fluid supply apparatus which is adaptive in its attachment to containers such that purchasers of the apparatus may use it on one or multiple such containers using an adaptive mount system thus alleviating the need to duplicate the device or replace it when the user buys a new water container or ice chest.

Further objects of the invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF THE PREFERRED EMBODIMENT OF THE INVENTION

Figure 1:
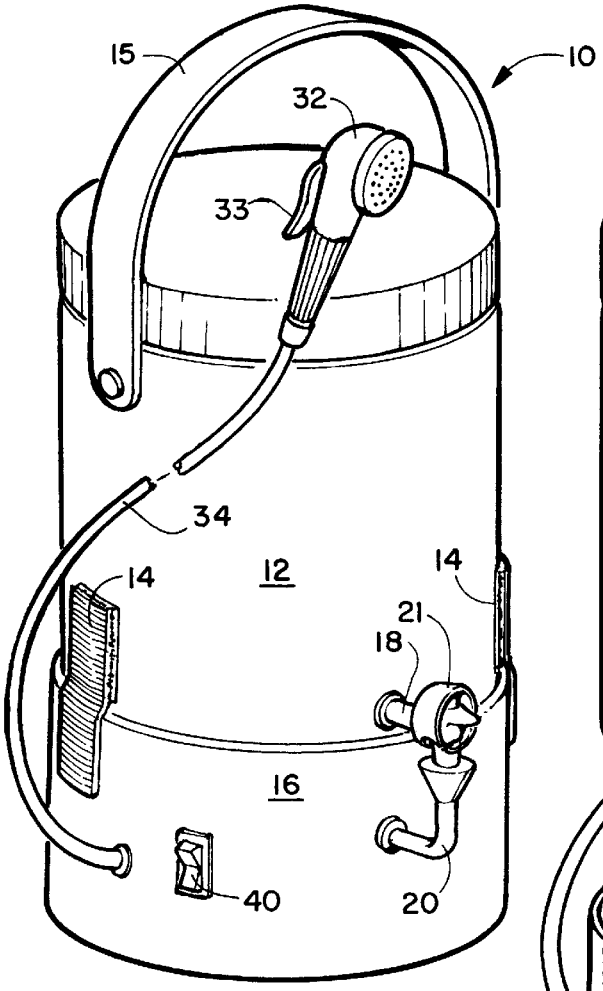
FIG. 1 is a perspective view of the invention showing a conventional round style insulated container for water or other liquid releasably mounted to the invention.

Referring now to the drawing FIGS. 1–6 show the invention 10 featuring a conventional round style insulated water container 12 for the transport of water or other liquid releasably mounted using hook/loop style fastening material 14. Such hook/loop fastening material may be easily attached to both the invention base 16 and to the container 12 with conventionally used adhesives for this purpose with no physical alteration of the cooler 12 or 13 being required other than adhesive on its exterior. The use of such fasteners 14 allows for easy mounting by the user when provided with the sale of the device and alleviates insulation and exterior damaging holes in the containers themselves which might be caused by screws or rivets. Other conventional fasteners may also be used when mounted in an operational relationship upon the-container 12 at the factory such as rivets or screws where damage can be avoided and also on the base 16, however the hook loop fabric 14 currently offers the easiest aftermarket manner for attachment to the container 12 with no physical modification thereto.

Such containers 12 and 13 conventionally have a spigot 18 which is selectively activated by the user using a biased push button or twist type valve which when activated allows a water or fluid stream to exit the container 12 through and exiting the spigot 18 for use when desired. Rectangular type ice chests or coolers 13 often also have a drain cock 18*a* in place of the spigot 18 to allow for drainage of fluids inside. A spigot receiving adaptor 20 with an entry aperture 20*a* at one end communicating with an interior conduit communicating which communicates with exit end of the adaptor 20. The adaptor 20 is best mounted upon the base 16 in a position to accept the exit portion of the spigot 18 in the entry aperture 20*a* in a releasably sealed relationship using an "o" ring or other conventional releasable sealing means between the aperture 20*a* and the exterior of the exit end of the spigot 18 when the container 12 is placed upon appropriately dimensioned top surface of the base 16. In this manner fluid exiting the spigot 18 enters, and may flow through the adaptor 20.

The base 16 has recessed top surface area 22 with a collar 24 sized and shaped to releasably attach to the exterior perimeter of conventionally used portable liquid containers 12 and 13 such as the Igloo® or Coleman® ice chests and water containers. Should additional adaptability be desired the base 16 can be configured in a modular fashion having a removable adaptive collar 26 attachable to the top surface 22 of the base 16. The adaptive collar mount 26 would be replaceable with differing sized adaptive mounts 26 and configurations to allow for mounting to the base 16 of differing sized and configured containers 12 and 13. This replaceable adaptive mount 26 thus allows for the same base 16 and enclosed pumping apparatus to be concurrently attachable to a wide variety of sizes and shapes of such conventionally used liquid containers and ice chests and for use of the same base 16 on newly acquired containers of the user and the collar could even be sold with the new container to allow it to be mounted to the prior acquired base. This adaptability yields the benefit of avoiding obsolescence and replacement when the size or configuration of the exterior of a container is changed in the future due to adding new containers to the owner's inventory or replacement of old containers 12 and 13.

The device 10 in its current best mode is easily manufactured from plastic material such as polyethylene, polypropylene, polyvinlycholride, or other plastic materials or mixtures thereof, by injection molding of the entire device or by formation of the device in pieces which are fitted together. Metal or ceramics could also be used.

The collar 24 being plastic may be formed using material having a resilient quality. If the resilient collar 24 is sized frictionally engage the perimeter of the liquid container 12 and 13, a sufficient frictional engagement between the base 12 and liquid container 12 and 13 may be achieved to alleviate the need for other attachment fastening using the hook loop fabric 14 or other connecting fasteners. However, the most secure releasable attachment is achieved using hook loop fabric 14 or conventional releasable mechanical fasteners and when the container is so attached to the base the user may feel comfortable carrying the mated container 12 and base 16 with the container handle 15. Of course the collar 24 might be eliminated in certain circumstances and the fasteners just used by attachment to the side of the container 12 and base 16 respectively or the bottom of the container 12 and top of the base 16 respectively, however the most sturdy and stable mating between the container 12 and the base 16 is achieved with the collar 24 configuration and an even more secure mount with the addition of fasteners such as hook and loop fabric 14. Which combination the user desires will depend upon the degree of stability required.

Figure 2:
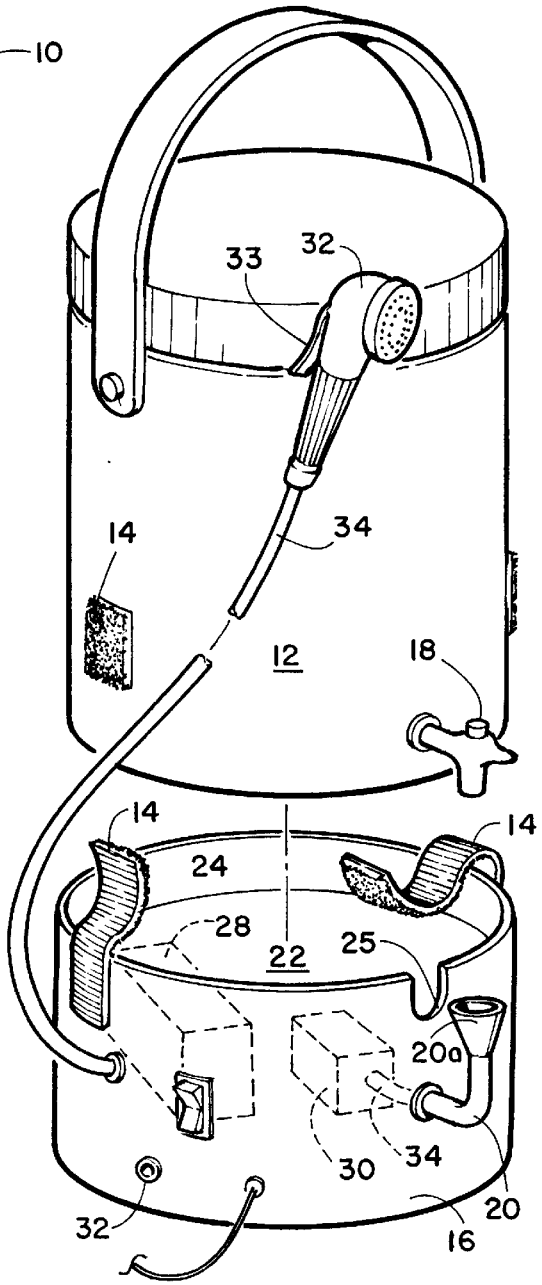
FIG. 2 is a view of the invention showing the container dismounted from the base of the invention.

FIG. 2 shows the round version of the container 12 being aligned for placement onto the top surface 22 of the base 16 showing the adaptive collar 24 having an optional notch 25 therein for accommodation of the protruding spigot 18 should such an accommodation be required to allow for the spigot 18 to engage the spigot receiving adaptor 20 properly. A sealed relationship between the spigot 18 and the spigot receiving adaptor 20 may be achieved using a conventional sealing relationship such as an "o" ring inside the spigot receiving adaptor 20 sealing upon the outside surface of the spigot 18.

The onboard battery 28 is shown on the interior of the base in phantom line as is the pump 30 also in phantom line.

When in use to provide a pressurized water supply and with the base 16 mated to a container 12 or 13, an on demand flow of fluid is provided using the conventional portable pump 30 such as those used for recreational vehicles in communication with the fluid stream from the exit end of the spigot receiving adaptor 20. Such conventionally used pump apparatuses have a pumping device 30 and an attached electric motor (not shown) providing the power to pump liquid communicated from inside the container 12 or 13 through the spigot 18 or 18*a* to the communicating spigot receiving adaptor 20 sealed thereon through the pump 30 and to the exit conduit from the pump 30.

In operation, such pumps begin pumping fluid when the attached motor is energized with a communicating electric supply by activating a switch 40 or other manner of providing electric current to the motor by completing the circuit attached thereto. A pressure sensor 42 in communication with the fluid stream in the conduit between the exit of the pump and the shower or spray head 32 deactivates the electric motor by disconnecting electric power therefrom using a switch which is part of or connected to the senor 42, when pressure builds to a pre prescribed level. Such a level is reached when fluid flow ceases at the outlet end of the pump 30 and fluid pressure builds to the pre prescribed shut off pressure level.

A spray attachment or shower head 32 or similar fluid control device such as a conventional spray nozzle or spray head configured for the use intended, is mounted at a distal end of a conduit 34 which is in communication with the outflow side of the pump 30 and therethrough also in communication between the container 12 and the intake port of the pump 30 as described above. The conduit is best made from plastic tubing, reinforced flexible tubing such as vinyl or polyethylene or rubber hose, or similar such conventionally used flexible hose materials, however the conduit from the exit end of the spigot receiving adaptor 20 to the inlet of the pump 30 and to the section of conduit feeding the shower head 32 could also be metal such as copper or aluminum tubing. For fluid flow control purposes the spray attachment or shower head 32 has an optional biased lever activated type or other conventional on/off valve 33 thereon. Once the pump 30 is energized by the attached motor being activated, the user can selectively activate the fluid flow from inside the container through the conduit system formed through the spigot 18 and adaptor 20 to the inlet of the pump 30 and exiting the pump by activation the on/off valve 33. When the user deactivates the on/off valve 33 the flow of liquid stops, building pressure in a conduit at the pump outlet 34 causing the pressure sensor 43 to open the electric circuit providing electric power to the pump motor ceasing pumping at the pre prescribed pressure level.

Electric power for electric pump motor 30 may be provided by an onboard battery 28 such as a small sealed mother cycle battery, or a conventional connection to a DC power supply 35 such as an automobile cigarette lighter or conventionally available solar panel 38, or to an AC power supply 36 connected to a plug in type conventional transformer 37, or by combinations of the above. The on board battery 28 can be recharged when connected to the AC power supply 36 and communicating transformer 37 by a concurrent convectional connection thereto, or to the DC power supply 35 while power is concurrently made available to the motor powering the pump.

In use in a portable manner the user would mate a container 12 or 13, which can be filled with hot or cold water or other fluid, to the accommodating base 16 connecting the spigot 18 with the spigot receiving adaptor 20 in a sealed releasable relationship by placing the container 12 or 13 onto the top of the base 16 and into the properly sized and shaped collar 24. The hook and loop fasteners 14, attached to the container 12 or 13 and the base 16 could thereafter be connected by mating the hook fabric with the loop fabric mounted upon both surfaces.

The power to the motor providing power to the pump 30 would then be switched on and fluid flow would be achieved through the shower head or spray adapter 32 when the on/off valve 33 of the spray adapter 32 is activated to the on position. Fluid flow would stop when the valve 33 is in the off position and the motor and an attached pump would cease-operation when the deactivated by the pressure sensor 42 or simply turned off by disconnecting electric power from the pump motor by unplugging it or using an on/off switch 40 to open the electric circuit. Of course a spray head or other conventional fluid nozzle could be used without the on/off valve 33 feature, but this would be less convenient to the user when washing dishes or taking a shower and cause the fluid supply in the container to possibly run out unless the electric power supplying the motor were turned off which is generally not advisable for a user to attempt when fluid is on their person which might conduct electricity.

Figure 3:
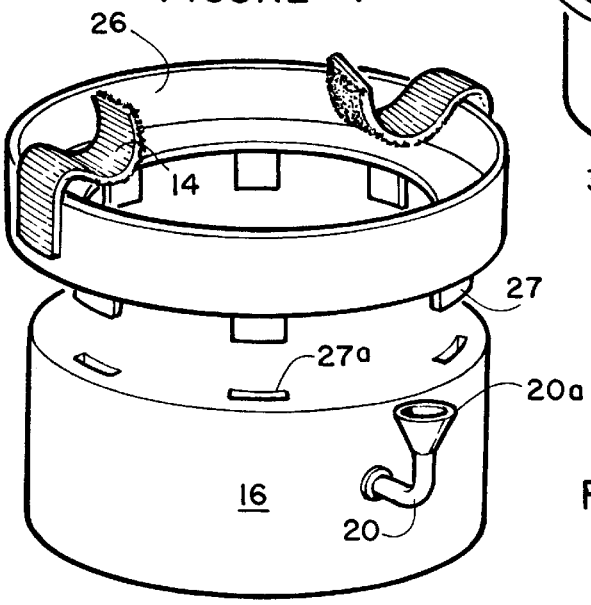
FIG. 3 is a perspective view of the invention featuring the adaptive mount separated from the base of the invention.

As shown in FIG. 3 an adaptive collar 26 may be used to achieve an adaptable mount to the base 16. For modular applications one or more adaptable collars 26 can be configured to concurrently accept multiple sizes and shapes of different containers 12 and 13 eliminating obsolescence of the unit 10 should the user buy a new container of a different size or configuration from the original container. Mounting pins 27 on the collar 26 would allow for mounting of the adaptive collar 26 to the base 16 by insertion thereof into cooperatively placed and sized pin apertures 27*a* in the base 16 however other mounting schemes are envisioned and anticipated.

To change the adaptive collar for a newly shaped or sized container the user would simply dismount it from the base 16 by separating the pins 27 from the apertures 27*a* and remount a properly pre configured adaptive collar 26 configured to accept the desired container 12 and 13 as needed.

Figure 4:
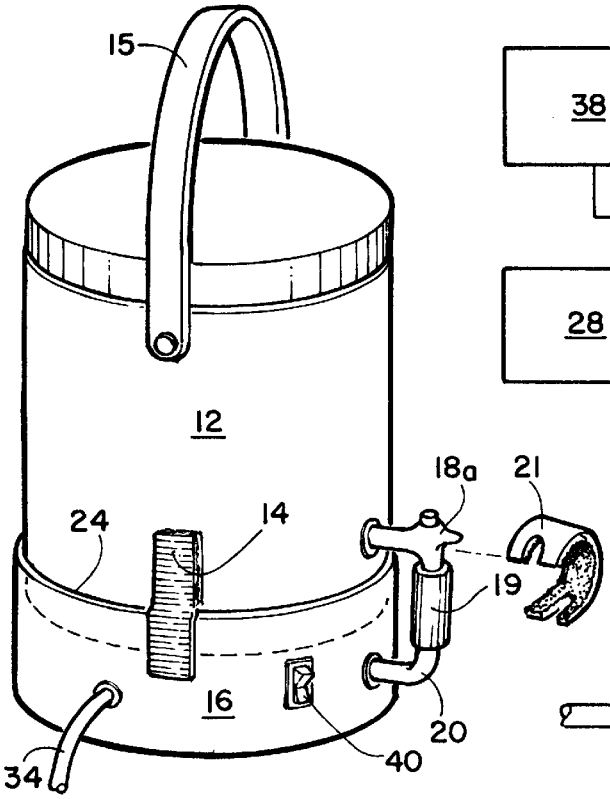
FIG. 4 is a side perspective view of a container releasably mounted to the base of the invention with the container spigot in communication with the fluid conduit supplying the pump.
Figure 6:
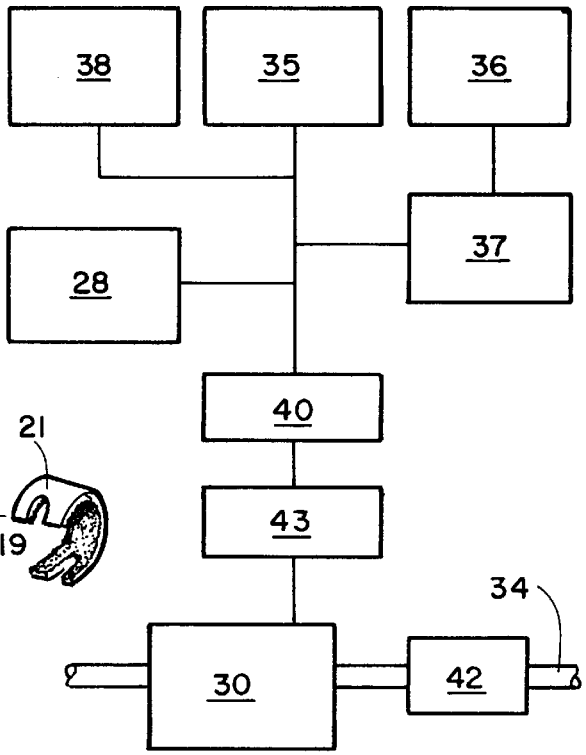
FIG. 6 depicts a flow chart of the fluid through the conduit to the pumping device portion of the invention and the various types of electrical power supplies to the pumping device.

FIG. 4 is a side view of a mated container 12 and base 16 showing the fasteners 14 fastened. An optional spigot conduit 19 connects the spigot 18 and the spigot receiving adaptor 20 in a sealed relationship at both its respective ends. Such an optional conduit 19 for this type of connection would also allow the conventional container 12 to communicate a fluid supply to the pump through the conduit while dismounted if desired or allow for connection of containers 12 and 13 when the accommodating adaptive collar 26 has not yet been purchased or received by the owner.

The spigot 18 is of a twist on/off type would provide fluid flow to the spigot receiving adaptor 20 through direct communication therewith or using the optional tubing connection therebetween, when twisted to the on position. When used with a spigot having a conventional push button or biased on/off valve 18*a*, an optional belt or clip 21 would be used keep the valve biased on allowing for fluid flow thorough the spigot 18*a* by wrapping it around the button to-keep it depressed. Hook/loop fabric or a belt with fasteners are best used for such a belt.

Figure 5:
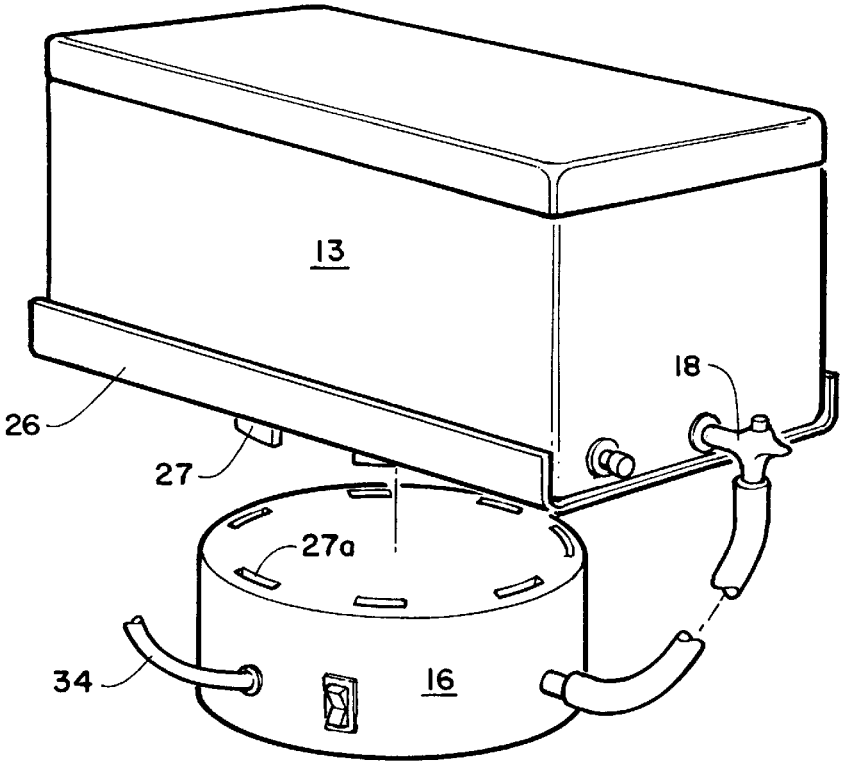
FIG. 5 shows the invention with an adaptive mount separated from the base which allows for connection of the invention to rectangular style coolers and ice chests.

As shown in FIG. 5, the collar 24 or adaptive collar 26 can also be easily configured using notches and adaptive shaping to accept rectangular container 13 other conventional container shapes. As such, the user of the device 10 is provided with an apparatus, which will mate to the majority of conventionally used and sold water containers and ice chests providing a water reservoir therein for a portable shower or a portable pressurized water supply for dish washing, or other desired purposes. The device, in mating to such conventional containers without altering or damaging them upon their exterior, allows the containers to be used without the device 10 for their original intended purpose to carry soft drinks or food therein, or, to carry potable water or other liquids therein for portable use.

While all of the fundamental characteristics and features of the pressurized fluid supply apparatus using a portable cooler for a reservoir invention herein have been shown and described, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. An apparatus for portable generation of a pressurized fluid supply for use in combination with a conventional insulated portable container such as an ice chest or insulated water container, comprising:

a base having a top wall said top wall having an inner surface and an outer surface, a bottom wall, said bottom wall having an interior surface and an exterior surface; and a side wall, said side wall having an inner sidewall surface and an outer sidewall surface, said top wall and said bottom wall connected to said side wall;

said outer surface of said top wall dimensioned to function as a pedestal for said portable fluid container;

an interior cavity of said base defined by the area between said inner side wall surface, said inner surface of said top wall, and said interior surface of said bottom wall;

a fluid pumping means attached to said base;

means for communication of fluid from inside said portable container to said fluid pumping means;

means for communicating fluid from said fluid pumping means to an exit spout for said fluid.

2. The invention as defined in claim 1 wherein said fluid pumping means comprises:

a fluid pump located in said interior cavity having an intake port and an outflow port;

an electric motor attached to said fluid pump for providing required power thereto;

electric power supply for communicating required electrical power to said motor.

3. The invention as defined in claim 2 wherein said electric power supply is a battery located upon said base and capable of communicating required electrical power to said motor on demand.

4. The invention as defined in claim 2 wherein said electric power supply consists of a means for attachment of said electric motor to a remote power source for communicating required electrical power to said electric motor.

5. The invention as defined in claim 4 wherein said remote power source is selected from one or a combination of a group consisting of a battery, a solar panel, AC power from a local power grid, a transformer powered by alternating current, a generator, and an automobile electrical system.

6. The invention as defined in claim 3 concurrently connectable to said remote power source.

7. The invention as defined in claim 1 further comprising a means for releasable attachment of said base to said portable fluid containers.

8. The invention as defined in claim 7 where said means for releasable attachment of said base to said portable fluid container comprises:

said outer surface of said top wall configured to accommodate said portable container placed thereon;

a resilient collar attachable to said base said resilient collar sized to frictionally engage the outside surface of said portable container when said portable container is placed upon said top wall.

9. The invention as defined in claim 7 where said means for releasable attachment of said base to said portable fluid container comprises:

separable fastening means having a first end attachable to said portable container and having a second end attachable to said base, said first end and said second end in positions for cooperative engagement whereby said portable container is removably secured to said base when placed thereon and said ends of said separable fastening means are joined.

10. The invention as defined in claim 8 where said means for releasable attachment of said base to said portable fluid container additionally comprises:

said separable fastening means attachable at said first end to said portable container and at said second end to one of said collar and said base in positions for cooperative engagement therebetween.

11. The invention as defined in claim 9 wherein said separable fastening means is comprised of hook and loop fabric.

12. The invention as defined in claim 10 wherein said separable fastening means is comprised of hook and loop fabric.

13. The invention as defined in claim 2 wherein means for communication of fluid from inside said portable container to said fluid pumping means comprises:

a spigot in said container having a passage therein said passage communicating with said interior of said portable container at one end and the outside of said container at the distal end of said spigot; a spigot receiving adaptor located on said base in a position for a cooperative engagement with the distal end of said spigot, said spigot receiving adaptor having a first end capable of releasable sealed engagement with the distal end of said spigot when cooperatively engaged, and a second end, said spigot receiving adaptor having a passageway therethrough in communication with said first end of said spigot receiving adaptor and said second end of said spigot receiving adaptor;

a first conduit connecting said second end of said spigot receiving adaptor and said intake port of said fluid pump;

a second conduit connected to said output port of said fluid pump at a first end and having an exit orifice at a distal end.

14. The invention as defined in claim 13 further comprising a fluid flow control device attached to said exit orifice.

15. The invention as defined in claim 14 wherein said fluid flow control device is one of a group consisting of a shower head, a nozzle, spray head.

16. The invention as defined in claim 14 further comprising a fluid pressure sensing means in communication with said second conduit whereby electric power to said electric motor is interrupted by said fluid pressure sensing means when fluid pressure in said second conduit rises to a predetermined level.

17. The invention as defined in claim 8 wherein said resilient collar is removably attachable to said base.

18. The invention as defined in claim 17 wherein said resilient collar and said base are of modular design such that said removably mountable resilient collar is replaceable with multiple removably mountable resilient collars of differing dimensions to accommodate frictional engagement by said removably mountable resilient collars with multiple portable containers of differing outside dimensions.

19. The invention as defined in claim 17 wherein removable attachment of said resilient collar to said base is accomplished using mounting pins located upon said resilient collar positioned for cooperative engagement with mounting pin apertures in said top wall of said base.

20. The invention as defined in claim 13 further comprising:

a valve said spigot having an on position for activation of fluid flow therethrough from said container, and an off position wherein fluid flow from said container ceases;

biasing means maintaining said valve by default in the off position; and, means for biasing said valve to the on position during use.

* * * * *